United States Patent [19]

Eylon et al.

[11] Patent Number: 4,482,398

[45] Date of Patent: Nov. 13, 1984

[54] METHOD FOR REFINING MICROSTRUCTURES OF CAST TITANIUM ARTICLES

[75] Inventors: Daniel Eylon, Dayton; Francis H. Froes, Xenia, both of Ohio

[73] Assignee: The United States of America as represented by the Secretary of the Air Force, Washington, D.C.

[21] Appl. No.: 574,433

[22] Filed: Jan. 27, 1984

[51] Int. Cl.[3] ..... C22F 1/18

[52] U.S. Cl. ..... 148/11.5 F; 148/12.7 B; 148/133; 148/158; 148/421

[58] Field of Search ..... 148/11.5 F, 133, 158, 148/2, 3, 421, 12.7 B

[56] References Cited

U.S. PATENT DOCUMENTS

| | | | |
|---|---|---|---|
| 2,974,076 | 3/1961 | Vordahl | 148/12.7 B |
| 3,340,051 | 9/1967 | Evans et al. | 75/175.5 |
| 3,649,374 | 3/1972 | Chalk | 148/12.7 B |
| 3,901,743 | 8/1975 | Sprague et al. | 148/133 |
| 4,167,427 | 9/1979 | Veda et al. | 148/133 |

OTHER PUBLICATIONS

D. Eylon, F. H. Froes, R. W. Gardiner, "Developments in Titanium Alloy Casting Technology", Journal of Metals, vol. 35, No. 2, Feb. 1983, pp. 35–47.

F. C. Teifke, N. H. Marshal, D. Eylon, F. H. Froes, "Advanced Processing Methods for Titanium", Conf. Proceedings, The Metellurgical Society of AIME, Oct. 13–15, 1981.

*Primary Examiner*—W. Stallard

*Attorney, Agent, or Firm*—Donald J. Singer; Charles E. Bricker

[57] ABSTRACT

The microstructure of titanium alloy castings is improved by a process which comprises beta-solution heat treating the cast article at or near the beta-transus temperature of the alloy, cooling the article to room temperature at a rate in excess of air cooling and aging the article at a temperature about 0.8 to 0.9 of the beta-transus.

11 Claims, 5 Drawing Figures

METHOD FOR REFINING MICROSTRUCTURES OF CAST TITANIUM ARTICLES

RIGHTS OF THE GOVERNMENT

The invention described herein may be manufactured and used by or for the Government of the United States for all governmental purposes without the payment of any royalty.

BACKGROUND OF THE INVENTION

This invention relates to the processing of cast titanium articles to improve the microstructure of such articles.

The major use of titanium castings is in the aerospace, chemical and energy industries. The aerospace applications generally require high performance cast parts, while the chemical and energy industries primarily use large castings where corrosion resistance is a major consideration in design and material choice.

The casting of titanium and titanium alloys presents a special problem due to the high reactivity of the material in the molten state. This requires special melting, mold-making practices, and equipment to prevent alloy contamination. At the same time, titanium castings present certain advantages when compared to castings of other metals. The microstructure of as-cast titanium is desirable for many mechanical properties. It has good creep resistance, fatigue crack growth resistance, fracture resistance, and tensile strength. Titanium alloy castings also readily lend themselves to full densification by hot isostatic pressing (HIP) because they dissolve their own oxides at high temperatures allowing a complete closure of all nonsurface-connected porosity by diffusion bonding. However, on the debit side, some cast-parts mechanical properties, particularly those which are initiation-related, such as smooth fatigue, are currently inferior to those exhibited by ingot metallurgy (IM) parts.

The melting practice used for cast-part production is essentially the same as for alloy ingot melting. Accordingly, it is possible to cast all titanium alloys produced by ingot metallurgy. The major difference between ingot metallurgy and cast metallurgy parts stems from the subsequent hot working and heat treatment of ingots or their products, which allow microstructural manipulations not possible in the cast part, such as, for example, equiaxed recrystallized alpha.

Accordingly, it is an object of the present invention to provide a process for improving the microstructure of a cast titanium article.

Other objects, aspects and advantages of the present invention will become apparent to those skilled in the art after reading the detailed disclosure of the invention as well as the appended claims.

SUMMARY OF THE INVENTION

In accordance with the present invention, there is provided a process for improving the microstructure of a cast titanium article which comprises, in combination, the steps of:

a. providing a suitable mold for the article;
b. providing a titanium molding material;
c. introducing the molding material into the mold to form the molded article;
d. separating the mold and the resulting net-shape or near net-shape cast article;

e. beta-solution heat treating the cast article for a relatively brief time;
f. cooling the article at a rate in excess of the air cooling rate;
g. aging the article at a suitable temperature for a suitable time; and
h. air cooling the article to room temperature.

DETAILED DESCRIPTION OF THE INVENTION

Figure 1:
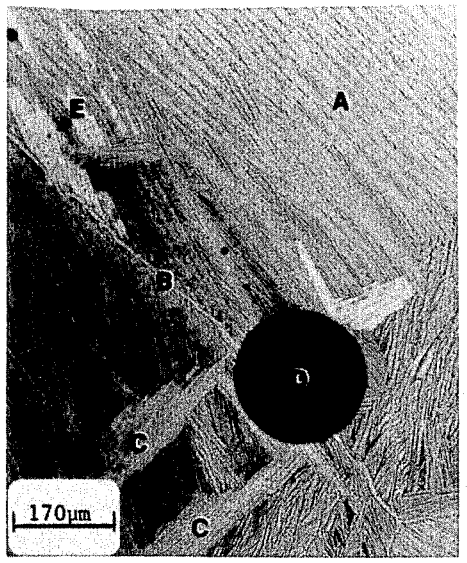
FIG. 1 is a photomicrograph illustrating the microstructure of a typical as-cast Ti-6Al-4V.

Titanium castings are produced predominantly from the Ti-6Al-4V alloy and various commercially-pure (CP) titanium grades. A number of other alloys have been cast, including Ti-6Al-6V-2Sn, Ti-6Al-2Sn-4Zr-2Mo, Ti-6Al-2Sn-4Zr-6Mo; Ti-6Al-2Sn-2Zr-2Mo-2Cr-0.25Si, Ti-5Al-2.5Sn, Ti-2.5Al-13V-7Sn-2Zr, Ti-10V-2Fe-3Al, and Ti-11.5Mo-6Zr-4.5Sn.

Three types of molds are currently used for casting titanium and its alloys: rammed graphite, ceramic and investment casting. Rammed graphite was the earliest commercial mold-making technique for casting titanium practiced in the United States. Traditionally, a mixture of properly size-fractioned graphite powder, pitch, corn syrup, starch and water is rammed against a wooden or fiberglas pattern to form a mold section. The mold sections are dried, then fired for 24 hours at 1025° C. causing the constituents to carbonize. Mold ramming is a labor intensive process which cannot be easily mechanized. The graphite mold is so hard that it must be chiseled off the cast parts. The castings are generally cleaned in an acid bath, followed if necessary by chemical-milling and weld repair, then sand blasted for good surface appearance.

Ceramic mold sections are generally produced from wood patterns. The ceramic molds are higher in cost than the rammed graphite molds and are more difficult to remove from the cast parts. Ceramic molds are most appropriate for large components requiring accurate dimensions.

Investment casting is adaptable to automation and production of large-quantity runs. In this method, a wax pattern is produced by injection molding. The pattern assembly is dipped in a ceramic slurry, stuccoed and dried. This is repeated several times to build a ceramic shell with sufficient strength to sustain the molding pressure. After drying the wax pattern is removed and the ceramic shell is dried. The ceramic shell is then filled with the titanium molding material, using a suitable molding apparatus. After casting, the ceramic shell is removed.

Following separation of the casting and the mold, the casting may, optionally, be densified by Hot Isostatic Pressing (HIP). Titanium alloys dissolve their own oxides at high temperatures allowing a complete closure of all nonsurface-connected porosity by diffusion bonding. The Hot Isostatic Pressing of titanium and titanium alloys may be carried out at a temperature about 5 to 10 percent below the beta-transus temperature of the alloy (based upon the Celcius scale) at pressures of 700–1000 bars (10–15 Ksi) for 2–4 hours. For example, the Hot Isostatic Pressing of Ti6Al4V, which has a beta-transus of 1000° C., is typically carried out in the temperature range of 890°–955° C. These conditions are similar to those used for titanium prealloyed powder HIP consolidation. In the case of titanium castings, a can or mold is unnecessary to obtain densification, which makes it a less expensive operation than powder consolidation. Hot Isostatic Pressing can enhance critical mechanical properties such as fatigue resistance, while causing no serious degradation in properties such as fracture toughness, fatigue crack growth rate, and tensile strength.

Hot Isostatic Pressing does not heal surface connected porosity. Therefore, weld repair is a common practice for filling gas porosity, shrinkage pores exposed by chemical milling, post-HIP surface depressions, or cold shuts for applications requiring defect-free components. Inert gas tungsten arc welding is typically used with alloy filler rods of regular or ELI (low-oxygen grade) material, followed by a stress relaxation heat treatment. Weld repair does not have an adverse effect on tensile properties, smooth bar high or low-cycle fatigue, fatigue crack growth rate, fracture toughness, creep rate, or creep rupture strength.

Stress relief, or aging heat treatment is typically carried out at about 20 to 30% below the beta-transus temperature (in °C.) for about 12 to 36 hours in a vacuum or inert environment to protect the surface of the cast part from oxidation. For example, the stress relief heat treatment of Ti6Al4V is typically carried out between 700°–850° C. Because of relatively slow cooling rates, particularly in rammed graphite molds, some castings may be used without a stress relief heat treatment. In other cases, a subsequent HIP cycle is effectively a stress relief treatment, because of the slow cooling rate in the HIP apparatus. Generally, the stresses in castings are residual stresses which result from cooling from the molten state, in contrast to residual strain in wrought material.

The method of the present invention comprises beta-solution treatment of a casting with rapid cooling to room temperature, preferably by quenching, followed by a relatively high temperature, relatively long aging heat treatment. The beta-solution treatment is accomplished by heating the casting to approximately the beta-transus temperature of the alloy, i.e., from about 3% below to about 10% above the beta-transus temperature (in °C.), followed by rapid cooling. In a presently preferred embodiment, the beta-solution treatment is carried out by heating the casting to a temperature in the approximate range of 0 to 3% above the beta-transus temperature of the alloy, followed by rapid cooling. The period of time at which the casting is held at or near the beta-transus temperature can vary from about 10 minutes to about 240 minutes, depending upon the cross-section of the casting. Thinner products will, of course, require a shorter holding time.

Cooling is accomplished by quenching the casting in a suitable liquid quenching medium, such as water or oil. The casting is then aged by heating to about 10 to 20 percent below the beta-transus temperature for about 4 to 36 hours followed by air cooling to room temperature.

The method of the present invention is applicable to titanium alloys, particularly those alloys of the near alpha and medium alpha+beta classes. An exemplary near alpha titanium alloy is Ti-6Al-2Sn-4Zr-2Mo, and an exemplary medium alpha+beta alloy is Ti-6Al-4V.

Beta-solution treatment with rapid cooling in accordance with the present invention results in a fine acicular structure. When the beta-solution treatment of this invention is followed by an aging heat treatment, the result is an alpha plate structure within a broken up beta matrix.

The benefits of the method of this invention are illustrated in FIGS. 1 through 5. A typical cast Ti6Al4V microstructure is shown in FIG. 1. Since the cast alloy is, in effect, cooled from above the beta-transus temperature and is subsequently at relatively high temperatures in the alpha-beta phase field for a significant period of time, the structure is basically a transformed beta structure. The beta grain size, item A, typically ranging from about 0.5 to 5 mm, develops during the cooling through the beta phase field, with slow cooling rates resulting in larger beta grains. As the beta grain size increases, properties such as fatigue crack growth rate (FCGR) improve.

Grain boundary alpha, item B, phase develops along the boundaries of the beta grains during the cooling through the alpha-beta phase region. This phase can reduce the fatigue life both at room and elevated temperatures. The grain boundary alpha phases most detrimental to fatigue strength are planar and positioned at approximately 45 degrees relative to the major stress axis.

Alpha plate colonies, item C, form on cooling below the beta-transus temperature. When the cooling rate is slow, as in castings, these plates are arranged in colonies or packets which are similarly aligned and have a common crystallographic orientation. These colonies are related to early fatigue crack initiation by a mechanism of intense shear across the colony plates. In a manner similar to the improvement of FCGR with increasing beta grain size, large alpha colonies can also result in improved FCGR. The alpha plate thickness ranges from about 1 to 3 microns and the colony size, typically, from about 50 to 500 microns. As a general rule, the slower the cooling rate in the alpha+beta phase region, the larger the colonies and the thicker the alpha plates. For this reason, thicker casting sections which solidify slower than the rest of the material will exhibit larger beta grains, thicker alpha plates and larger alpha plate colonies.

In as-cast parts, porosity should be considered as part of the structure since pores appear to control properties such as fatigue. Two types of pores are found: the first, indicated by D, is the result of trapped gas and has a spherical shape; the second, indicated by E, shrinkage porosity can be as small as a few microns, or as large as a few millimeters, typically with an interdendritic inner pore structure.

Figure 2:
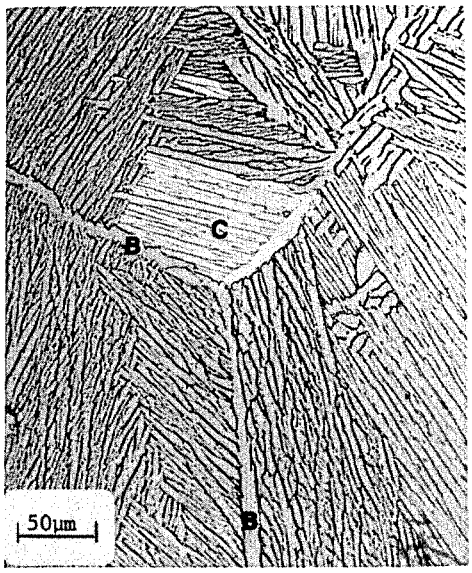
FIG. 2 is a photomicrograph illustrating a typical cast Ti-6Al-4V microstructure after Hot Isostatic Pressing.

FIG. 2 illustrates a typical cast Ti6Al4V microstructure after Hot Isostatic Pressing. The trapped gas pores and shrinkage pores have been closed, and are no longer indicated. The beta and alpha grains, and plate colonies remain substantially the same as shown in FIG. 1.

Figure 3:
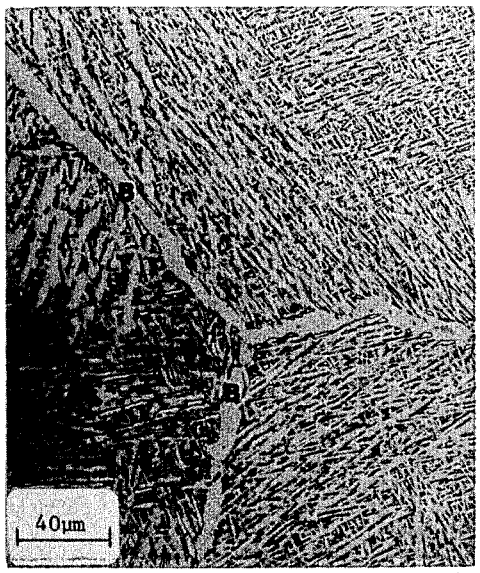
FIG. 3 is a photograph illustrating a Ti-6Al-4V cast part following treatment in accordance with the invention.

FIG. 3 illustrates a broken-up alpha plate structure resulting from beta solution treatment in accordance with the present invention.

Figure 4:
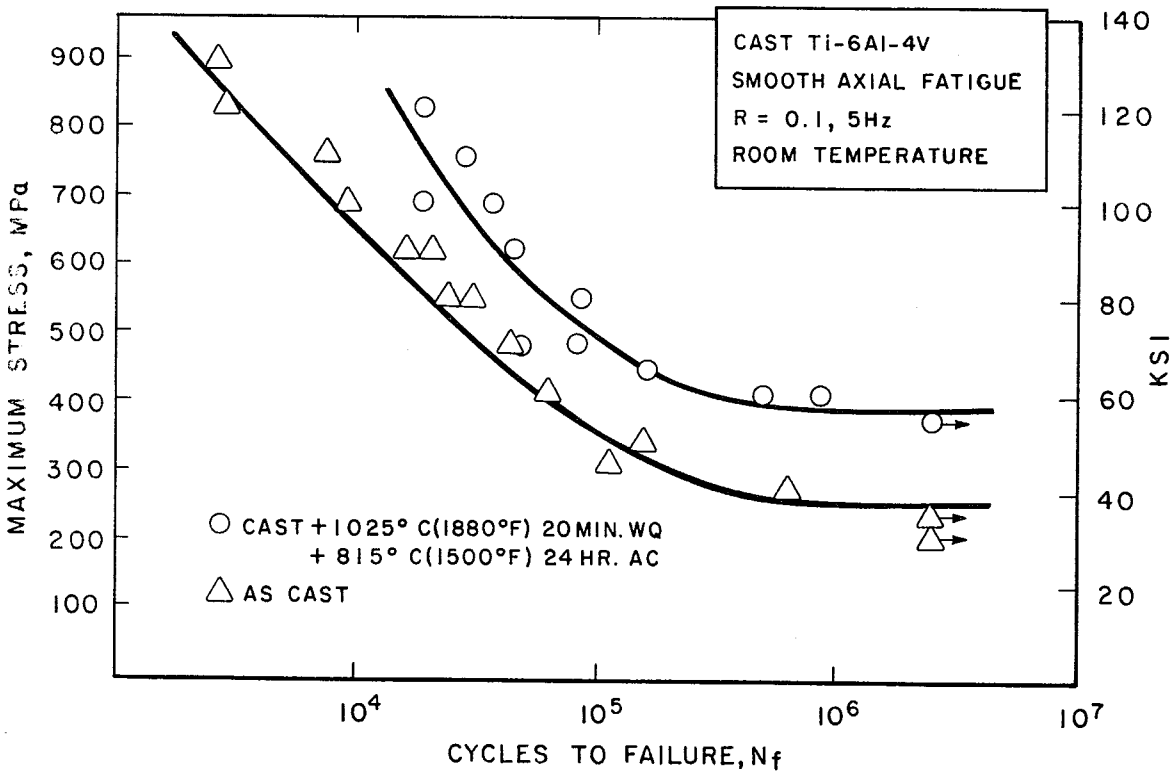
FIGS. 4 and 5 are graphs illustrating the smooth axial fatigue strength of cast Ti-6Al-4V coupons, both untreated and treated in accordance with the invention.
Figure 5:
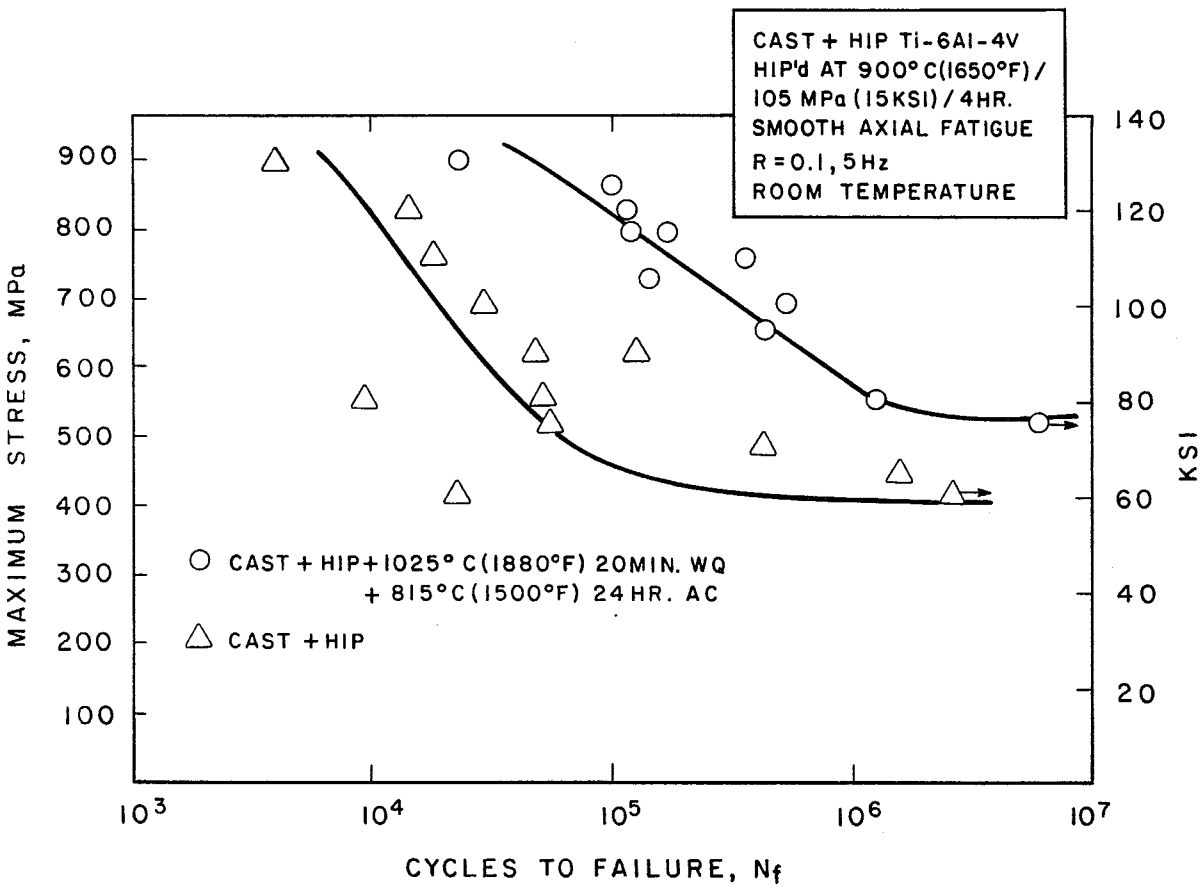

FIGS. 4 and 5 illustrate the smooth axial fatigue strength of a series of Ti6Al4V coupons taken from cast aircraft brake drums obtained from TiLine, Inc., P.O. Box 729, Albany, Ore. These brake drums were cast using a rammed graphite mold. The higher fatigue strength which is achieved by the heat treatment of the present invention is shown in FIG. 4 in comparison to results from an untreated coupon, produced at the same time as the treated material. FIG. 5 illustrates the higher fatigue strength which is achieved by heat treating cast coupons which have been subjected to Hot Isostatic Pressing. The 80 Ksi fatigue limit is comparable to the fatigue limit for wrought annealed Ti-6Al-4V.

The method of this invention is generally applicable to the manufacture primary airframe, engine components and other aircraft components, as well as non-aerospace components. By improving the fatigue strength of titanium alloy castings to the fatigue strength level of forged titanium alloy components it now becomes possible to use cast components in structures in which fatigue strength is a major concern. Examples of such applications include: elevon housings for cruise missiles, load-carrying components for aircraft wings and integrated blade and disc structures for gas turbine engines. The use of cast components in place of forged components may also result in substantial cast reduction.

Various modifications may be made to the present invention without departing from the spirit and scope of the invention.

We claim:

1. A process for improving the microstructure of a cast titanium article which comprises the steps of:

a. providing a cast titanium article;

b. beta-solution heat treating said cast article at a temperature approximately equal to the beta-transus temperature of said article;

c. cooling said article at a rate in excess of air cooling to room temperature;

d. aging said article at a temperature in the approximate range of 0.80 to 0.90 times said beta-transus temperature for about 4 to 36 hours; and e. air cooling said article to room temperature.

2. The process of claim 1 wherein said beta-solution heat treatment is carried out at a temperature ranging from about 3% below to about 10% above said beta-transus temperature for about 10 to 240 minutes.

3. The process of claim 1 wherein said beta-solution treatment is carried out at a temperature in the approximate range of 0 to 3% above said beta-transus temperature for about 10 to 240 minutes.

4. The process of claim 1 wherein said cast article is cast from an alpha-beta titanium alloy.

5. The process of claim 4 wherein said alloy is Ti-6Al-4V.

6. The process of claim 1 wherein said cast article is cast from a near-alpha titanium alloy.

7. The process of claim 1 further comprising the step of hot isostatic pressing said cast article prior to said beta-solution heat treating step.

8. The process of claim 7 wherein said hot isostatic pressing is carried out by heating said article to a temperature in the approximate range of 5 to 10% below said beta-transus temperature at a pressure in the approximate range of 10–15 Ksi for about 2 to 4 hours.

9. An article of manufacture comprising a component cast from a titanium alloy, subjected to beta-solution heat treatment by heating said cast component to a temperature approximately equal to the beta-transus temperature of said alloy and cooling said component at a rate in excess of air cooling to room temperature, and aged by heating said component to a temperature in the approximate range of 0.80 to 0.90 of said beta-transus temperature for about 4 to 36 hours and air cooling said component to room temperature.

10. The article of manufacture of claim 9 wherein said component is an aircraft brake drum.

11. An article of manufacture in accordance with claim 9 which further is subjected to hot isostatic pressing prior to said beta-solution heat treatment.

* * * * *